US006906626B2

(12) United States Patent
Novotny

(10) Patent No.: US 6,906,626 B2
(45) Date of Patent: Jun. 14, 2005

(54) BURGLAR ALARM AND DOOR CHIME

(76) Inventor: Raymond J. Novotny, 2345 Hailey Ct., Fogelsville, PA (US) 18051

( * ) Notice: Subject to any disclaimer, the term of this patent is extended or adjusted under 35 U.S.C. 154(b) by 497 days.

(21) Appl. No.: 09/811,134

(22) Filed: Mar. 17, 2001

(65) Prior Publication Data

US 2001/0030605 A1 Oct. 18, 2001

Related U.S. Application Data

(60) Provisional application No. 60/195,704, filed on Apr. 7, 2000.

(51) Int. Cl.[7] ..... G08B 13/08

(52) U.S. Cl. ..... 340/545.1; 340/384.7; 340/528; 340/547; 340/693.5

(58) Field of Search ..... 340/545.1, 547, 340/528, 384.7, 693.5

(56) References Cited

U.S. PATENT DOCUMENTS 3,714,643 A * 1/1973 Sosin et al. ..... 340/542
3,720,937 A * 3/1973 Lang et al. ..... 340/543
3,851,325 A * 11/1974 Maged ..... 340/542
3,866,201 A * 2/1975 Beiswenger ..... 340/528
3,896,427 A * 7/1975 Campman ..... 340/540
4,123,752 A * 10/1978 Novotny ..... 340/545.1
4,258,358 A * 3/1981 Lee et al. ..... 340/543
5,268,671 A * 12/1993 Novotny ..... 340/545.2
RE35,638 E * 10/1997 Novotny ..... 340/545.1
6,218,938 B1 * 4/2001 Lin ..... 340/540

* cited by examiner

*Primary Examiner*—Thomas Mullen
(74) *Attorney, Agent, or Firm*—Sanford J. Piltch

(57) ABSTRACT

An improved battery operated combination burglar alarm and door chime mounted to the inside of a door from where the alarm and chime modes are selected. A dead bolt slide cooperates with a jamb plate fastened to the door frame to manually arm the device from the inside with the door closed. Opening the door activates the dead bolt and sounds the alarm. A magnetically sensitive switch within the device cooperates with a magnet fastened to the jamb plate and further cooperates with a mode selection switch to effect either the chime mode or delayed alarm mode when the door is opened. The delayed alarm mode is activated with the door open to permit pre-arming the device followed by automatic arming of the device when the door is closed. Depending upon the alarm mode selected, unauthorized opening of the door can either lock the door from further opening and instantaneously sound an alarm to protect an occupied dwelling or sound an alarm after a predetermined time when the door has been fully opened to protect an unoccupied dwelling. A combination switch deactivates the alarm and chime modes. Other switches can alter the switch combination. A smoke detector may be integrated with the above.

24 Claims, 3 Drawing Sheets

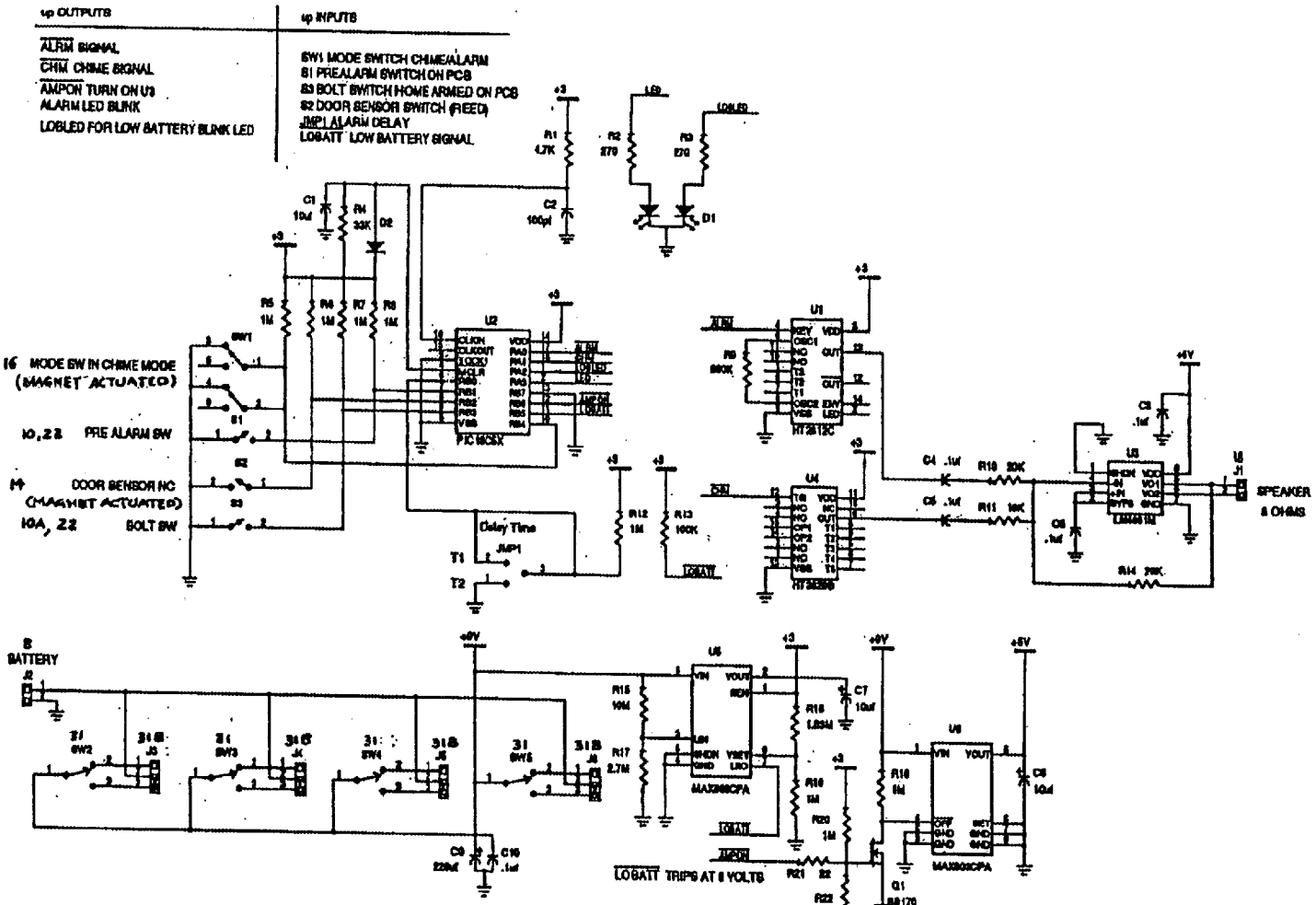
up INPUTS
SW1 MODE SWITCH CHIME/ALARM
S1 PRE/ALARM SWITCH ON PCB
S3 BOLT SWITCH HOME ARMED ON PCB
S2 DOOR SENSOR SWITCH (FEED)
JMP1 ALARM DELAY
LOBATT LOW BATTERY SIGNAL
up OUTPUTS
ALRM SIGNAL
CHM CHIME SIGNAL
AMPON TURN ON U3
ALARM LED BLINK
LOBLED FOR LOW BATTERY BLINK LED
16 MODE SW IN CHIME MODE (MAGNET ACTUATED)
10,22 PRE ALARM SW
14 DOOR SENSOR NC (MAGNET ACTUATED)
10A, 22 BOLT SW
B BATTERY
SPEAKER 8 OHMS
LOBATT TRIPS AT 6 VOLTS
FIG. 7

BURGLAR ALARM AND DOOR CHIME

This application claims benefit of Provisional Application 60/195,704 filed Apr. 7, 2000.

BACKGROUND OF THE INVENTION

This invention relates to an improved battery operated burglar alarm in combination with a door chime adapted to a door or the like. Specifically, the device is an improvement in function and structure over my previously patented devices described in U.S. Pat. Nos. 4,123,752, 5,268,671 and RE 35,638. This device relates to an improvement in the sensing means with a simpler structure having fewer parts and easier assembly with increased reliability.

For example, the improvements in this invention to overcome the problems with the Novotny devices (U.S. Pat. No. RE 35,638, etc.) are explained as follows. The entire costly and unreliable mechanical sensing spring-activated plunger assembly (10, 12, 14) mounted to top cover (11), that requires direct contact with jamb plate (13) is eliminated including its cooperating make-break slide switch (15). Also, frictional wear caused by the rubbing action of plunger (12) against the bottom face of jamb plate (13) shortened the plunger (12) length after considerable use and affected the reliable triggering of break-make switch (15). In this invention, to overcome the above cost and wear problems, components, 10, 12, 14 of RE 35,638 are replaced by a permanent magnet (12) integrated into jamb plate (13) and a reed switch (14) mounted to printed circuit board (23) to achieve the combination of electrical logic functions required.

The costly 3-position instant lock-alarm slide switch (22) mounted to printed circuit board (23) is eliminated including the slide switch actuator (21) attached to slide (19). Misalignment mating problems between slide switch button (22A) with slide switch actuator (21) arose during the assembly of the front cover subassembly to the back plate (2). The cutout in slide switch actuator (21) must precisely engage slide switch button (22A) during assembly of the front cover subassembly to the back plate (2) to which the printed board circuit (23) and hence the 3-position instant lock-alarm slide switch (22) is already attached.

In this invention, to overcome the above misalignment assembly problem, the costly 3-position instant lock-alarm slide switch (20) and slide switch actuator (21) of U.S. Pat. No. RE 35,638 are replaced by a single bifurcated spring (22) attached to slide (19). The contact legs of bifurcated spring (22) automatically align themselves to mate with printed circuit board pads (10 and 10A) located on printed circuit board (23) as the front cover (11) is assembled to the back cover (2); the front cover (11) and back cover (2) each being part of front and back cover subassemblies respectively. This new structure prevents any final assembly misalignment problem between mating subassembly components during the final two subassemblies to form the final assembly of the Burglar Alarm and Door Chime.

This invention, like those of U.S. Pat. Nos. RE 35,638 and 5,268,671, includes the combination of instantaneous and simultaneous mechanical locking and alarm means for internal security and mode selection means for achieving the door chime mode or re-entry alarm delay mode. An optional smoke detector is also included. Further, detailed background information may be found in U.S. Pat. Nos. RE 35,638 and 5,268,671 and, for brevity, is not repeated here,. e.g.: reference to its use and advantages on doors in apartments, condos and single family homes.

SUMMARY OF THE INVENTION

Accordingly, in addition to the objects and advantages described in my U.S. patents previously noted, the overall objects and advantages of the present invention are:

a) to provide a door-mounted security device having non-contact sensing means between the door-mounted device and its stationary doorjamb counterpart to provide a simpler structural combination and improve reliability and functions with either metal, plastic composite or wood fabricated doors.

b) to provide a door-mounted security device having three operating security modes and convenient switching means between operating modes, namely:

1) to instantaneously actuate a deadbolt lock and simultaneously sound an alarm when unauthorized opening of a door occurs.

2) to permit re-entry of an authorized person and allow sufficient delay time to de-arm the device and prevent the alarm from sounding, 3) to provide for a pleasant door chime tone mode to audibly monitor the opening and closing of a door during normal use.

4) to conveniently switch between re-entry and chime security modes.

c) to provide a device that can be manufactured to adapt within its structure a known smoke detection sensing unit having its own battery.

d) to manufacture a device that consists of two main subassemblies, namely: a mechanical and an electrical subassembly that are self-aligning during assembly to comprise the final assembly of the device.

e) to provide mechanical and electrical subassemblies that are complete by themselves and can be manufactured and tested independently of each other.

f) to provide a multiple color blinking light source visible from the front or side of the device that indicates the arming status of the instantaneous and delay arming modes.

Another object of the invention is to provide a security device that is easily installed on a door by the average homeowner, condo or apartment dweller without requiring special tools, material, knowledge, technique or rework of the existing door and frame structure.

It is still another object of this invention to provide homeowners and particularly condo and apartment dwellers, who must leave and return to their premises daily, a convenient, simple and reliable alarm device for their doors that does not require additional keys or other separate means to arm or de-arm the device upon leaving or entering their premises and means to change the de-arming code as needed.

Another object of this invention is to provide a device, the location of which is readily accessible to the authorized person but is mounted in a relatively inaccessible or tamper-proof location to the unauthorized person.

Still, a further object of this invention is to provide means for making the present device inoperative during periods of normal use.

The above objects as well as other and further objects, features and advantages of the present invention will be manifest in the following detailed description and preferred embodiment thereof when read in connection with the accompanying drawings which form a part of this specification. However, it must be clearly understood that these descriptions and drawings are not to be construed as defining the limits of the invention, for which purpose reference is made to the appended claims.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

FIG. 7 is a wiring diagram showing the various switches and other electronic components, in symbolic form, required to achieve the necessary operational modes for the burglar alarm and door chime.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figures 1, 2, 3:
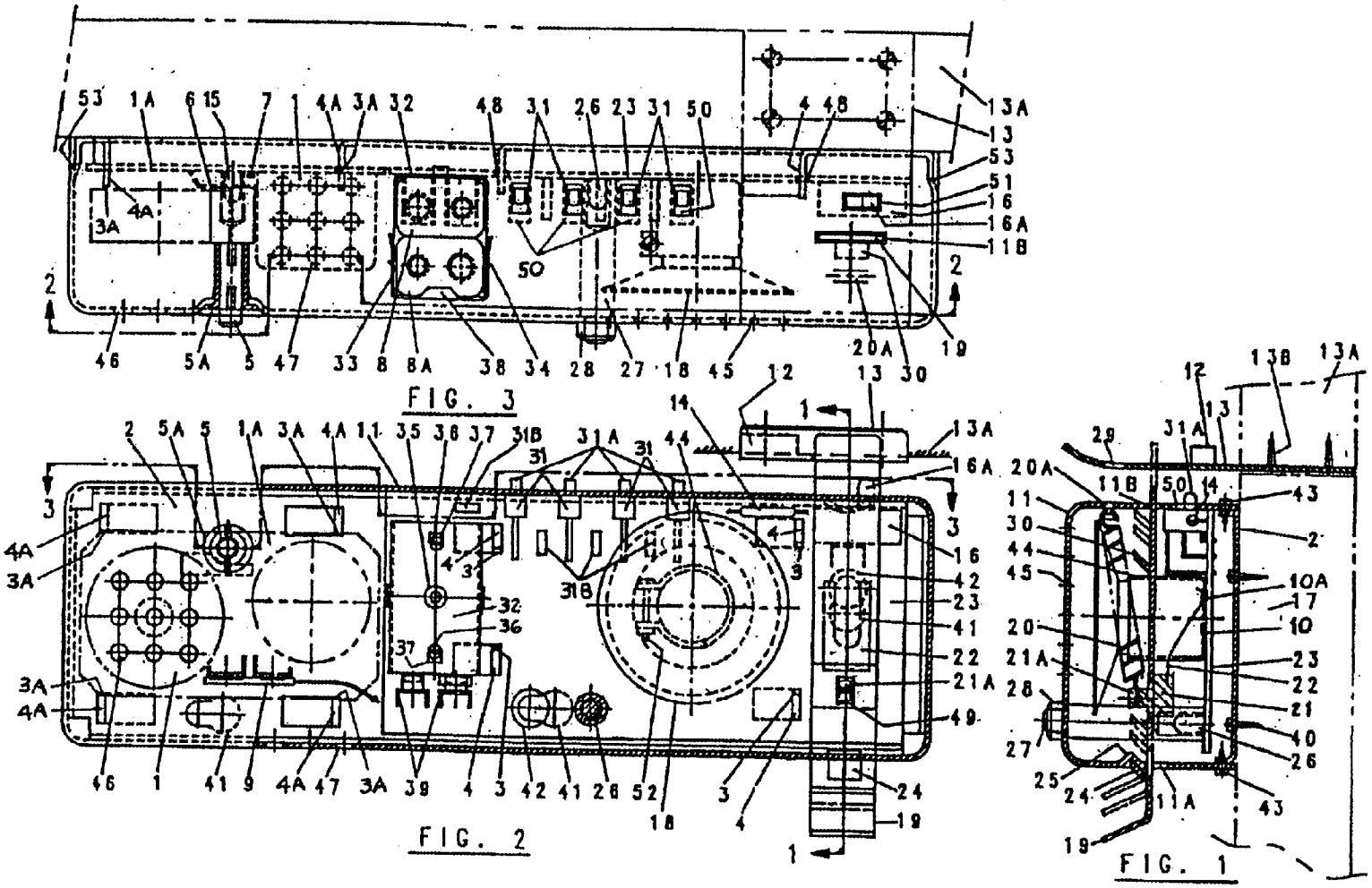
FIG. 1 is a sectional view taken through the slide and door mounted jamb plate as shown by section plane 1—1 of FIG. 2.
FIG. 2 is a front view of the battery operated burglar alarm and door chime taken from inside the front cover in accordance with section plane 2—2 of FIG. 3.
FIG. 3 is a top view of the device based on the section plane 3—3 of FIG. 2.

Refer in detail to the drawings, wherein like and related numerals and symbols designate like and related parts throughout the several views. FIG. 1 shows a sectional view of the device mounted to a door (17) by means of a back plate (2), preferably fabricated of metal using back plate screws (40) through back plate screw holes (41). Mounted to back plate (2) is a printed circuit board (23) to which switches, detailed electrical components, speaker and batteries with holder are fastened. Four back plate printed circuit board tabs (4) having "V" grooves (3) are shown in FIGS. 2 and 3 formed from back plate (2) to secure printed circuit board (23) against back plate (2) by means of an interference fit with printed circuit board slots (48). As a result, the printed circuit board assembly constitutes a completely independent electrical subassembly that cooperates with adjacent mechanical components to achieve the various operational modes.

A front cover (11), also preferably fabricated of metal, fits over back plate (2) and is fastened to back plate (2) using front cover screws (43). A slide (19) fits through the bottom and top surfaces of front cover (11) through front cover slide slots (11A and 11B) respectively to cooperate with jamb plate (13) containing jamb plate slot (29) and fastened to doorjamb (13A) using jamb plate screws (13B). Slide (19) has a lower slide tab (24) made to fit with a lower front cover detent (25) at its lower end and has an upper slide tab (30) at its other end. Spring-biased slide switch contact legs (22) attached to holder (21) is attached to slide (19). Spring-biased slide switch contact legs (22) contact, in turn, lower printed circuit board contact pads (10) and upper printed circuit board contact pads (10A) to respectively arm and lock-alarm the device. A slide switch holder tab (21A) of slide switch holder (21) fits through slide (19) by means of a slide tab slot (49). A spring (20) is attached to the end of slide switch holder tab (21 A) and to the top end to upper front cover detent (20A).

Figure 6:
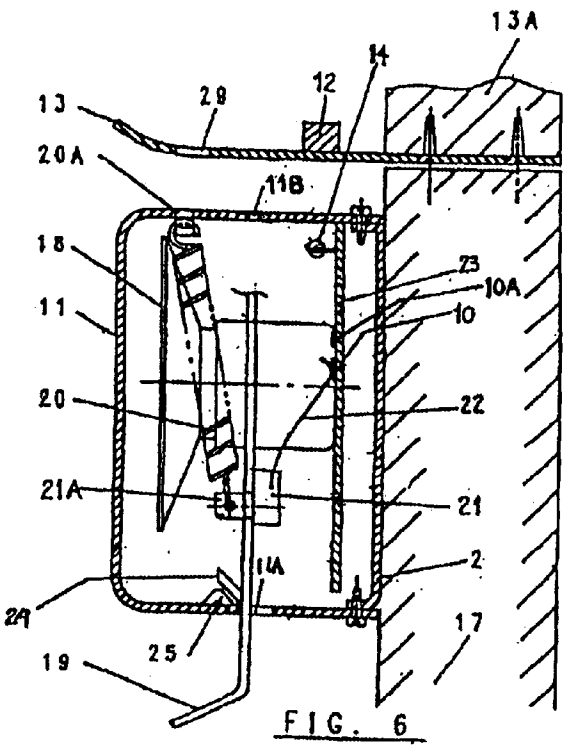
FIG. 6 is a sectional view taken through the door, slide, magnetically sensitive switch and jamb plate with magnet, and also shows the bifurcated switch as shown by section plane 6—6 of FIG. 4.
Figure 5:
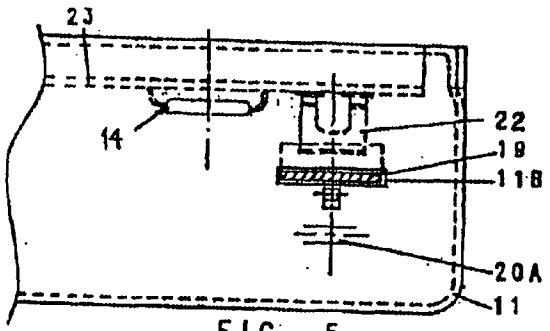
FIG. 5 is a partial right top view of the device showing the magnetically sensitive switch and bifurcated slide switch with the door-jamb plate removed as shown by view 5—5 of FIG. 4.
Figure 4:
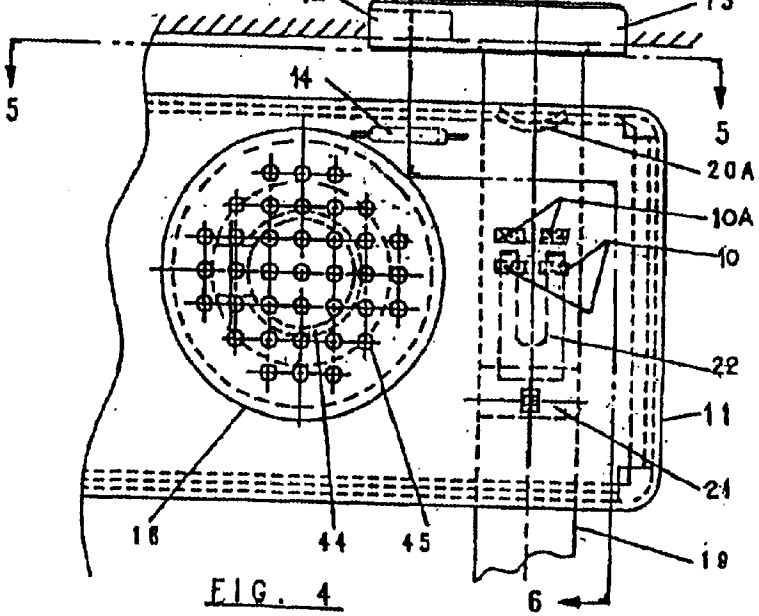
FIG. 4 is a partial right from view of the device showing the top end of the slide in contact with the door jamb plate.

FIGS. 4, 5 and 6 show the magnetically sensitive switch (14) in relation to jamb plate (13) with mounted magnet (12) and their relationship to printed circuit board (23). Also, the relationship of spring-biased slide switch contact legs (22) is shown with respect to the lower and upper printed circuit board contact pads (10 and 10A, respectively).

Four On/Off power two-position slide switches (31) are fastened to printed circuit board (23) at its top edge. The On/Off slide buttons (31A) of On/Off power two-position slide switches (31) protrude above the top of front cover (11) through front cover top slots (50) for access as shown in FIGS. 1, 2, and 3.

FIGS. 2 and 3 show a chime and delay alarm mode selection two-position slide switch (16) fastened to printed circuit board (23) at its top edge. The chime and delay alarm mode selection slide button (16A) of chime and delay alarm mode selection two-position slide switch (16) protrudes above the top of front cover (11) through a front cover top slot (51) for access.

A bottom battery holder (32) is fastened to printed circuit board (23) with rivet (35) or suitable adhesive and stabilized with two battery holder key tabs (36) protruding through two circuit board key tab clearance holes (37). Two batteries (8 and 8A) are secured in place by a top battery holder (33) which fastens to batter holder (32) by snapping over and engaging two battery holder locking tabs (34). Battery (8) is electrically connected to printed circuit board (23) using two battery snap terminals (39) which, in turn, are mechanically fastened and electrically connected to printed circuit board (23). Battery (8) supplies power to the Burglar Alarm and Door Chime device. Battery (8A) supplies power to the optional smoke detector sensing unit (1). Top battery holder tabs (38) prevent battery (8A) from sliding out of position.

A light emitting diode (26) is fastened to printed circuit board (23) and transfers its light to the outside of front cover (11) by using a light conducting plastic cylinder (27) fastened to front cover (11) using a plastic cylinder retaining ring (28) and located in-line with light emitting diode (26).

A speaker (18) is fastened to printed circuit board (23) using a suitable adhesive or a mechanical speaker clamp (44) which, in turn, is adhesively bonded to circuit board (23). A multitude of speaker sound transmitting openings (45) are located in front cover (11) and in-line with speaker (18). Two printed circuit board clearance holes (42) are provided for access to back plate screw holes (41). Front cover detents (53) of FIG. 3 located in the sides of front cover (11) provide for a fixed depth of assembly of back plate (2) with respect to front cover (11).

FIG. 7 shows a detailed electrical circuit schematic of the basic Burglar Alarm and Door Chime. Battery (8) supplies power to the Burglar Alarm and Door Chime device through the four On/Off power two-position slide switches (31) to the spring biased slide switch contact legs (22) and its circuitry, the chime and delay alarm mode selection two-position slide switch (16) and its circuitry. All of the foregoing actuate speaker (18) with its circuitry to sound an alarm and flash light emitting diode (26). Four jumper pin switches (31B) provide means to reverse the polarity of said four On/Off power two-position slide switches (31). Circuits to provide means to vary the entry delay time and warn of low battery voltage are included.

FIGS. 2 and 3 show an optional smoke detector sensing unit (1), fastened to back plate (2) and connected to battery (8A) using snap cable (9). Four back plate smoke detector tabs (4A) formed from back plate (2) and having "V" grooves (3A) provide a snap interference fit with the smoke detector printed circuit board (1A) to which all smoke detector components are mounted. A multitude of smoke detector openings (47) are provided in addition to a multitude of smoke detector sound transmitting openings (46) are located in front cover (11).

A smoke detector light transmitting test plunger (5) is enclosed and captured by a smoke detector guide bushing (5A) which is snap fastened to front cover (11). The smoke detector light transmitting test plunger (5) is piloted over a smoke detector light emitting diode (15) and is also in-line with a smoke detector sensing unit spring test contact (6) to enable contact with a smoke detector sensing unit fixed test contact (7) to check the working status of smoke detector sensing unit (1).

Operation of the Preferred Embodiment

The thee modes of operation of the Burglar Alarm and Door Chime, achieved by positioning the chime and delay alarm mode selection two-position switch (16), the on/off two-position slide switches (31), and the slide (19), are as follows:

Instant Lock-Alarm/Interior Security Mode:

Refer to FIG. 1 showing slide (19) in the "unarmed slide position" with door (17) closed. The four On/Off power two-position slide switches (31) are shown in FIG. 3 in a power "Off" mode with their slide tabs oriented toward the back plate (2). Move any one or several of the slide tabs (31A) toward the front cover (11) to effect the "On" mode of the four On/Off power two-position slide switches (31). Disengage slide tab (24) of slide (19) from the front cover detent (25) of front cover (11). Allow slide spring (20) to raise slide (19) until it engages the underside of jamb plate (13). During this movement, slide switch holder (21) of slide (19) will move spring-biased slide switch contact legs (22) to contact the lower printed circuit board contact pads (10) to effect the "armed slide position" from its original "unarmed slide position." This slide position causes light emitting diode (26) to flash and transfer its light to the outside of front cover (11) by using light conducting plastic cylinder (27) fastened to front cover (11). The flashing light indicates to an authorized person located on the interior side of the second area that the device is in the armed mode. Unauthorized opening of door (17) causes slide (19) to pass through jamb plate slot (29) to achieve the "instant lock-alarm position" by effecting a dead bolt lock with jamb plate (13) and simultaneously moving spring-biased slide switch contact legs (22) to contact upper printed circuit board contact pads (10A) to effect the "lock-alarm" mode and sound speaker (18). Moving slide (19) back to the "unarmed slide position" will not cause speaker (18) to stop sounding. However, placing the four On/Off power two-position slide switches (31) in the one "Off" mode known only to the authorized person will cause the speaker (18) to cease sounding.

Delay Alarm/Exterior Security Mode:

Refer to FIGS. 2, 3, and 7 with the door (17) closed and showing the four On/Off power two-position slide switches (31) in the one "Off" mode and the chime and delay alarm mode selection two-position slide switch (16) in the right slide position to effect the Delay Alarm/Exterior Security Mode. Placing the four On/Off power two-position slide switches (31) in one of the fifteen "On" combinations effects power to this mode and in cooperation with the magnet (12) mounted to jamb plate (13) and the magnetically sensitive switch (14) mounted to the printed circuit board (23) causes, at this time, light emitting diode (26) to flash in a periodic series of three flashes in green light to further indicate the Delay Alarm/Exterior Security Mode is active in preparation to secure the interior area. Opening the door (17) from the interior area to be secured changes the state of magnetically sensitive switch (14) and, referring to FIGS. 6 and 7 causes light emitting diode (26) to commence flashing in a periodic series of two flashes in amber light which confirms the pre-arm condition of the Delay Alarm/Exterior Security Mode. The authorized person will then exit the interior area to be secured into the exterior area and close the door (17). This action causes the Delay Alarm/Exterior Security Mode of the device to arm; light emitting diode will cease flashing. Unauthorized opening of door (17) will cause speaker (18) to sound after a preset delay period and cause light emitting diode (26) to flash in a periodic series of single flashes of red light. Closing door (17) will not silence speaker (18) or cause light emitting diode (26) to cease flashing since the electric circuit is latched. However, placing the four On/Off power two-position slide switches (31) in the one "Off" combination known only to the authorized person will silence speaker (18) and cause light emitting diode (26) to cease functioning and de-arm the device.

Door Chime Annunciator Mode;

Referring again to FIGS. 2, 3 and 7 which show the four On/Off power two-position slide switches (31) in the one "Off" mode and the chime and delay alarm mode selection two-position slide switch (16) in the right slide position to effect the Delay Alarm/Exterior Security Mode. However, to achieve the Door Chime Annunciator Mode, move the chime and delay alarm selection two-position slide switch (16) to the left slide position and place the four On/Off power two-position slide switches (31) in any one of the fifteen "On" combinations. Opening and closing door (17), will alternately break and make the magnetically sensitive switch (14) due to magnet (12) and cause speaker (18) to emit pleasant chime tones.

Optional Smoke Detector Sensing Unit:

In conjunction with any of the operational modes described herein, the device may include an optional smoke detector sensing unit. FIGS. 2 and 3 show an optional, independently powered smoke detector sensing unit (1) of known manufacture mounted to back plate (2). Smoke passing through smoke detector openings (47) in front cover (11) will trigger the smoke detector to sound through transmitting openings (46) also located in front cover (11). Pressing smoke detector light transmitting test plunger (5) checks the functionality of smoke detector sensing unit (1) by sounding its horn. Periodic flashing of light from light emitting diode (15) and transmitted to the tip of light transmitting test plunger (5) is a further indication of the unit's proper functionality, e.g.: low battery voltage.

While my above description contains many specificities, these should not be construed as limitations on the scope of the invention, but rather as an exemplification of one preferred embodiment thereof. Many other variations are possible. For example, the front cover (11) and back plate (2) may be fabricated of suitable plastics. Rocker or magnetic actuated switches may be substituted for the On/Off power two-position slide switches where applicable. Also, the number of On/Off power switches (31) may vary from the four switches shown. A piezoelectric speaker may be used instead of the magnetic/coil type. Further, the slide (19) may be cylindrical in cross-section instead of rectangular and so forth. Also, a non-contact opto-electric sensing means using a light beam from a source mounted to the jamb plate (13) and directed through a hole in the top of the front cover to a sensing receiver mounted to a printed circuit board or internal bracket within the hollow enclosure of the device to trigger electric logic circuits within the device is another non-contact sensing means.

Accordingly, the present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

What is claimed is:

1. A burglar alarm and door chime comprising:

circuit logic means mounted to a back plate fastened to the inside of a door, said circuit logic means receiving control inputs from chime/delay alarm modes electric switching means and On/Off power electric switching means to select a delay alarm mode or a chime mode of said burglar alarm and door chime, instant lock-alarm mode electric switching means, and non-contacting sensing means, said circuit logic means further cooperating with an audible alarm and chime means and an independent electric power supply means;

a front cover containing manual arming spring-biased instant lock-alarm slide means cooperating with said instant lock-alarm mode electric switching means of said burglar alarm and door chime when said front cover is fastened to said back plate;

a jamb plate fastened to an opposing doorjamb cooperating with said manual arming spring-biased instant lock-alarm slide means during the opening of said door to actuate the instant lock-alarm mode of said burglar alarm and door chime; and said non-contacting sensing means comprising a transmitting means attached to said jamb plate and a receding means attached to said back plate, said receiving means responsive to said transmitting means to automatically actuate said selected delay alarm mode or said selected chime mode responsive to the opening and closing of said door.

2. The burglar alarm and door chime of claim 1 wherein said spring-biased instant lock-alarm slide means attached to said front cover cooperates with said instant lock-alarm switch means to actuate an instant audible alarm having electric circuit latching means and simultaneously slidingly engages as a mechanical dead bolt lock in cooperation with said jamb plate.

3. The burglar alarm and door chime of claim 2 wherein said spring-biased lock-alarm slide means comprises a slide having armed, instant lock-alarm, and unarmed slide positions slideably attached to said front cover, said slide being spring-biased to move through slots in said front cover to manually engage said jamb plate for the armed slide position, said jamb plate containing a cooperating aperture to automatically capture said slide during the opening of said door to engage the slide in the instant lock-alarm slide position, said slide having stop means engageable with said front cover to retain the slide in the unarmed slide position.

4. The burglar alarm and door chime of claim 3 wherein said circuit logic means includes variable time delay means for said delay alarm mode and light indicating means responsive to said unarmed, armed, and instant lock-alarm slide positions of said spring-biased lock-alarm slide means in said delay alarm mode.

5. The burglar alarm and door chime of claim 1 further including a smoke detection sensing unit fastened to said burglar alarm and door chime.

6. The burglar alarm and door chime of claim 5 wherein said smoke detection sensing unit comprises a visual functional indicating means, a manual testing means, and an independent power supply means.

7. The burglar alarm and door chime of claim 1 wherein said receiving means comprising a magnetically actuated switch attached to said back plate is responsive to said transmitting means comprising a permanent magnet attached to said jamb plate during the opening and closing of said door, said magnetically actuated switch cooperating with said chime/delay alarm modes electric switching means and said On/Off power electric switching means to effect a pre-arm condition of said delay alarm operational mode during the opening of said door, and subsequently to activate said magnetically actuated switch to effect an armed condition of said delay alarm operational mode during the closing of said door and enabling a pre-set entry delay time means of said circuit logic means to be responsive to the subsequent opening of said door to actuate said audible alarm means after a pre-determined delay time in said selected delay alarm operational mode of said burglar alarm and door chime, or to actuate said audible chime means during the opening of said door in said selected chime operational mode of said burglar alarm and door chime.

8. The burglar alarm and door chime of claim 7 wherein said chime/delay alarm modes electric switching means comprises manual selection mode switching means whereby chime or delay alarm operational modes may be manually selected for said burglar alarm and door chime.

9. The burglar alarm and door chime of claim 1 wherein said On/Off power electric switching means comprising a plurality of accessible manfully operated electric switching means in conjunction with said electric power supply means to manually activate or deactivate said burglar alarm and door chime cooperates with additional electric switching means to set and alter the unique combination of first and second positions of individual switches of said On/Off power electric switching means required to activate and deactivate said burglar alarm and door chime.

10. The burglar alarm and door chime of claim 1 further including a low battery sensor and visual battery status indicating means visible through the front cover.

11. A burglar alarm and door chime comprising:

a back plate fastened to a front cover forming a hollow enclosure therewith, said back plate fastened to a door on the protected enclosure side of said door, said back plate having a power supply means and a printed circuit board comprising a circuit logic means fastened thereto, said circuit logic means including chime/delay alarm modes electric switching means to select a delay alarm mode or a chime mode of said burglar alarm and door chime, On/Off power electric switching means to enable said selected mode, instant lock-alarm mode electric switching means, and audible alarm and chime means interconnected with said printed circuit board;

said front cover containing manual arming spring-biased instant lock-alarm slide means and a bifurcated leaf spring contact means attached to said spring-biased instant lock-alarm slide means and electrically insulated therefrom, said bifurcated leaf spring contact means engaging said instant lock-alarm mode electric switching means;

non-contact sensing means comprising a transmitting means attached to a jamb plate and a receiving means attached to said circuit logic means, said receiving means responsive to said transmitting means to automatically actuate said selected delay alarm mode or said chime mode responsive to the opening and closing of said door;

said transmitting means comprising a permanent magnet and said receiving means comprising a magnetically actuated switch;

said jamb plate fastened to the opposing door jamb having a cooperating aperture to automatically capture said manual arming spring-biased instant lock-alarm slide means of said front cover during the opening of said door to effect the instant lock-alarm mode of said burglar alarm and door chime;

said audible alarm and chime means being responsive to the opening and dosing of said door to annunciate an audible alarm corresponding to said delay alarm mode or an audible chime corresponding to said chime mode according to said selected mode of said burglar alarm and door chime.

12. The burglar alarm and door chime of claim 11 wherein said spring-biased instant lock-alarm slide means attached to said front cover cooperates with said instant lock-alarm switch means to actuate an instant audible alarm having electric circuit latching means and simultaneously slidingly engages as a mechanical dead bolt lock in cooperation with said jamb plate.

13. The burglar alarm and door chime of claim 12 wherein said spring-biased lock-alarm slide means comprises a slide having armed, instant lock-alarm, and unarmed slide positions slideably attached to said front cover, said slide being spring-biased to move through slots in said front cover to manually engage said jamb plate for the armed slide position, said jamb plate containing a cooperating aperture to automatically capture said slide during the opening of said door to engage the slide in the instant lock-alarm slide position, said slide having stop means engageable with said front cover to retain the slide in the unarmed slide position.

14. The burglar alarm and door chime of claim 13 wherein said circuit logic means includes variable time delay means for said delay alarm mode and light indicating means responsive to said unarmed, armed, and instant lock-alarm slide positions of said spring-biased lock-alarm slide means in said delay alarm mode.

15. The burglar alarm and door chime of claim 11 further including a smoke detection sensing unit fastened to said burglar alarm and door chime.

16. The burglar alarm and door chime of claim 15 wherein said smoke detection sensing unit comprises a visual functional indicating means, a manual testing means, and an independent power supply means.

17. The burglar alarm and door chime of claim 11 wherein said permanent magnet comprising a rare earth magnet attached to said jamb plate is responsive to said magnetically actuated switch comprising a magnetically responsive reed switch, said rare earth permanent magnet and said magnetically responsive reed switch cooperating with said chime/delay alarm modes electric switching means and said On/Off power electric switching means to effect a pre-arm condition of said delay alarm operational mode during the opening of said door and subsequently to activate said magnetically responsive reel switch to effect an armed condition of said delay alarm operational mode during the dosing of said door and enabling a pre-set entry delay time means of said circuit logic means to be responsive to the subsequent opening of said door to activate said audible alarm means after a predetermined delay time in said selected delay alarm operational mode of said burglar alarm and door chime, or to activate said audible chime means during the opening of said door in said selected chime operational mode of said burglar alarm and door chime.

18. The burglar alarm and door chime of claim 17 wherein said chime/delay alarm modes electric switching means comprises manual selection mode switching means whereby chime or delay alarm operational modes may be manually selected for said burglar alarm and door chime.

19. The burglar alarm and door chime of claim 11 wherein said On/Off power electric switching means comprising a plurality of accessible manually operated electric switching means in conjunction with said electric power supply means to manually activate or deactivate said burglar alarm and door chime cooperates with additional electric switching means to set and alter the setting of the unique combination of first and second positions of individual switches of said On/Off power electric switching means required to activate and deactivate said burglar alarm and door chime.

20. The burglar alarm and door chime of claim 11 further including a low battery sensor and visual battery status indicating means visible through the front cover.

21. A burglar alarm and door chime comprising:

a self-contained operational electrical subassembly containing circuit logic means and electric power supply means mounted to a circuit board, said circuit logic means comprising On/Off power electric switching means, instant lock-alarm mode electric switching means, chime/delay alarm modes electric switching means, and an audible alarm means, said circuit board detachably secured to a back plate, said back plate removably fastened to a door;

a mechanical subassembly comprising a front cover including mechanical manual arming spring-biased instant lock-alarm actuation means and spring-biased switching means attached thereto cooperating with said circuit board to actuate said instant lock-alarm mode of said burglar alarm and door chime during the opening of said door, said mechanical subassembly removably interconnected with said back plate;

manually operated mode selection switching means including said instant lack-alarm and chime/delay alarm modes electric switching means of said circuit logic means cooperating to manually select among an instant lock-alarm mode, a chime mode, and a delay alarm mode;

said On/Off power electric switch means operating in conjunction with said electric power supply means to activate or deactivate said burglar alarm and door chime and cooperating with additional electric switching means to set and alter the unique combination of first and second positions of individual switches of said On/Of power electric switch means required to actuate and deactivate said burglar alarm and door chime;

non-contacting sensing means comprising switch actuation means electrically interconnected to said circuit board responsive to transmitting means attached to a jamb plate further attached to an opposing door jamb to automatically actuate said selected delay alarm mode or said selected chime mode responsive to the opening and closing of said door;

said audible alarm means responsive to said non-contacting sensing means when one of said modes is selected to emit an audible alarm or chime upon the opening of said door;

a variable time delay means of said circuit logic means to delay the sounding of said audible alarm or chime;

said manual arming spring-biased instant lock-alarm actuation means comprising a slide for engaging a cooperating aperture in said jamb plate attached to said door jamb to simultaneously provide a mechanical deadbolt lock upon the opening of said door in said selected instant lock-alarm mode.

22. The burglar alarm and door chime of claim 21 wherein said circuit logic means includes light indicating means responsive to unarmed, pre-arm, armed, and lock-alarm operational states of said manual arming spring-biased instant lock-alarm actuation means in cooperation with said chime/delay alarm modes electric switching means.

23. The burglar alarm and door chime of claim 21 further including a smoke detection sensing unit independently fastened to said back plate including independent power supply means, said smoke detection sensing unit comprising a visual functional indicating means and a manual testing means attached to said front cover of said mechanical subassembly and extending therethrough, to provide for visual and manual operational testing of said smoke detection sensing unit from said front cover.

24. The burglar alarm and door chime of claim 21 further including a low battery sensor and visual battery status indicating means visible through the front cover.

* * * * *